US006622750B1

(12) United States Patent
Bergeron

(10) Patent No.: US 6,622,750 B1
(45) Date of Patent: Sep. 23, 2003

(54) UNIVERSAL CEILING LEAK DIVERTER SYSTEM

(76) Inventor: David Francis Bergeron, 81 Loudville Rd., EastHampton, MA (US) 01027-9735

( * ) Notice: Subject to any disclaimer, the term of this patent is extended or adjusted under 35 U.S.C. 154(b) by 0 days.

(21) Appl. No.: 10/360,024

(22) Filed: Feb. 8, 2003

(51) Int. Cl.[7] ..... G05D 7/00; B67C 11/02

(52) U.S. Cl. ..... 137/312; 52/302.1; 137/15.11; 137/357; 141/86; 141/337; 222/108

(58) Field of Search ..... 52/302.1, 302.3, 52/302.7, 506.01, 506.06, 791.1; 137/15.11, 312, 357; 141/86, 337; 222/108

(56) References Cited

U.S. PATENT DOCUMENTS

| | | | | | |
|---|---|---|---|---|---|
| 4,245,666 | A | * | 1/1981 | Norris | 137/357 |
| 4,313,457 | A | * | 2/1982 | Cliff | 137/312 |
| 4,450,855 | A | * | 5/1984 | Hills | 137/312 |
| 4,633,899 | A | * | 1/1987 | Lord | 137/357 |
| 4,809,734 | A | * | 3/1989 | Cliff | 137/312 |
| 5,172,718 | A | * | 12/1992 | Thornburgh | 137/312 |
| 5,299,591 | A | | 4/1994 | Duncan | 137/312 |
| 5,492,158 | A | * | 2/1996 | Haag | 137/312 |
| 5,738,139 | A | * | 4/1998 | DeChard | 137/312 |
| 6,283,144 | B1 | | 9/2001 | Kahn | 137/357 |

OTHER PUBLICATIONS

Inventor Listed As Paul Shepard Device Name "Inbrella" Advertised as Patented, but was Unable to Find Patent Info After Several Searchs of USPTO On–Line Databases Known Information Provided on Attached Examplar of Prior Art Letter 2 pgs.

* cited by examiner

*Primary Examiner*—George L. Walton

(57) ABSTRACT

A liquid diverter system comprising a plastic panel with the collector panel portion angled downward from all corners and sides to a circular recessed drain mounting land to divert liquids to a suitable storage container or disposal area. A perpendicular flange formed at outer edge creates a reservoir capable of holding liquids when immediate drainage is not possible. A non-woven plastic mesh pad in the collector panel prevents debris from clogging the drain, absorbs sound made by falling water and eliminates splashing.

4 Claims, 6 Drawing Sheets

UNIVERSAL CEILING LEAK DIVERTER SYSTEM

FIELD OF THE INVENTION

The present invention relates to a device for protecting a building's interiors and contents from damaging effects of fluids falling from damaged roofs, faulty plumbing and condensation that forms and drops from heating, ventilation and air-conditioning devices installed above suspended ceilings. More particularly it is a replacement tile, herein occasionally referred to as Port A Tile, a registered trademark, for use in suspended ceilings.

BACKGROUND OF THE INVENTION

Of greatest concern are the many commercial, public, and private buildings that are constructed with flat roofs and utilize suspended grid ceiling installations to create usable hidden space between the underside of the roof slab or intermediate floors and the visible decorative underside of the suspended ceiling in work and building access areas. The hidden space is utilized for installation of fire and smoke warning devices, fire control, sprinkler systems, computer networking, telecommunications, electrical conduits, heating, ventilating, and air condition ducts. Also, suspended ceilings are found in buildings of all types, and many are below, and hide from view, pipes and other systems that can leak.

Accordingly, situations occur wherein water leaks from damaged roofs. Areas of condensation build up on utilities and climate control devices installed in the space above suspended grid ceilings. The accumulated leaks and condensates fall causing damage to the decorative ceiling materials, subsequently entering, and damaging the occupied space of the building, thereby inconveniencing or injuring the building inhabitants and accoutrements.

Consequently there exists a need for a device that installs quickly, conforms to the existing grid support system typical of commercially available suspended ceilings, blends aesthetically with the occupied space and allows continued use of the building without inconvenience while repairs are being planned and implemented.

Prior art in this field has significant problems as demonstrated by U.S. Pat. No. 5,299,591 issued Apr. 5, 1994 to Duncan; Harry P. which describes a device for a similar purpose as the present invention but fails to recognize that any build up of water within the panel will increase stresses on the rim, and the entire panel will fall on the inhabitants below. The present invention overcomes this omission by including vertical structural flanges to support the panel and allow a simple means of attaching the panel to the grid rails.

As provided by the objects of the present invention the Duncan device is not functional in that it offers no defense against large pieces of falling debris blocking the entire drain apparatus opening and clogging the drain opening completely. Further, the Duncan device as described and illustrated makes no attempt to alleviate the problem of damage to adjacent areas that is caused by splashing of falling liquids on impact with a non-dissipative surface. The Duncan device also makes no attempt to alleviate the problem of distracting noise caused by falling liquids impacting with an impervious membrane supported at its periphery. The Duncan device is intrusive to the work area or common areas immediately under it and will cause distraction and lack of attention to tasks being performed in the immediate area, and the Duncan Device makes no attempt to facilitate the attachment of several leak collecting devices to a common drain line.

Other prior art, which does not anticipate the features of the present invention, is disclosed by U.S. Pat. No. 6,283,144 issued Sep. 4, 2001 to Kahn, Mackey. Kahn addresses leak damage in ceilings other than the grid type suspended ceilings. The Kahn device is intrusive and destructive to environment where it is installed. It fails to meet the objects of the present invention and teaches away from providing a temporary system that causes no damage and installs easily. By requiring "nails or screws" as fasteners such a system will leave permanent holes and damage to the original ceiling. With the present invention, restoring the original ceiling after repairs are complete entails simply replacing the "sort A Tile" leak diverter with the original ceiling panel.

OBJECTS OF THE CURRENT INVENTION

An object of the current invention is to provide a means for collecting water or other fluids leaking from intended containment systems and diverting them to a disposal system without damaging or harming a buildings fixtures, materials, inhabitants or other accoutrements. A further object is to provide an easily installed temporary system until repairs can be made. A further object is to provide a leak diverter device and drain line that is aesthetically harmonious with educational, commercial and residential pursuits. Another object is to avoid any leak related noise that will not be conducive to continuing educational, commercial and residential pursuits. Also an object is to provide a means that will prevent debris from reaching and clogging the drain line. A further object of the device is to provide means that will eliminate splashing onto adjoining undamaged ceiling panels. A further object of the device is to provide a complete leak diverter system that can be installed quickly, without destructive attachment devices such as nails or screws, and still another object is to provide a leak diverter system that allows several panels to be joined together in a leak proof grid to match the area of falling liquid. A further object of the invention is to provide a complete leak diverter system comprising of two or more panels that can be connected to a single drain line.

DESCRIPTION OF THE PREFERRED EMBODIMENT

Figure 1:
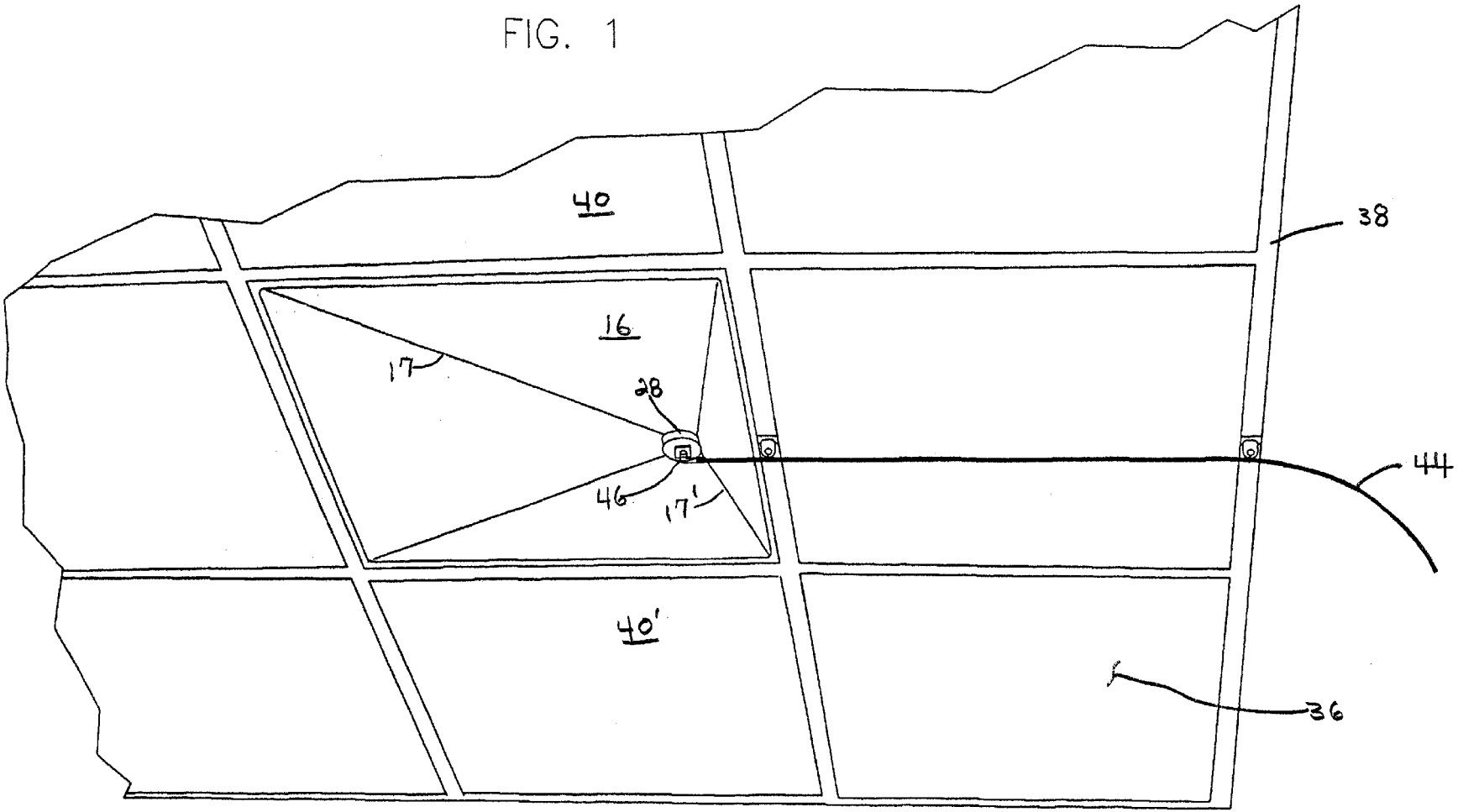
FIG. 1 is a pictorial showing the leak diverter in operative position in suspended ceiling grid.
Figure 3:
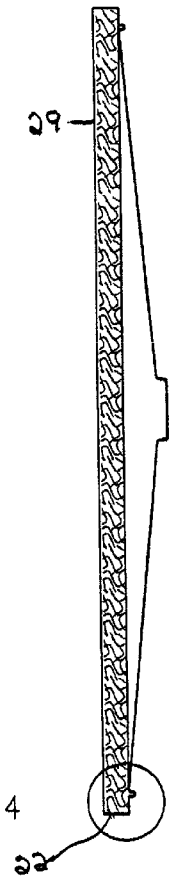
FIG. 3 is a sectional view through the drain hole.
Figure 4:
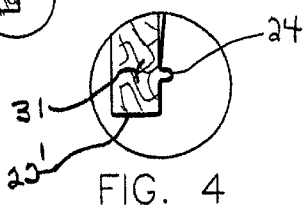
FIG. 4 shows an enlarged view of a panel corner.
Figure 2:
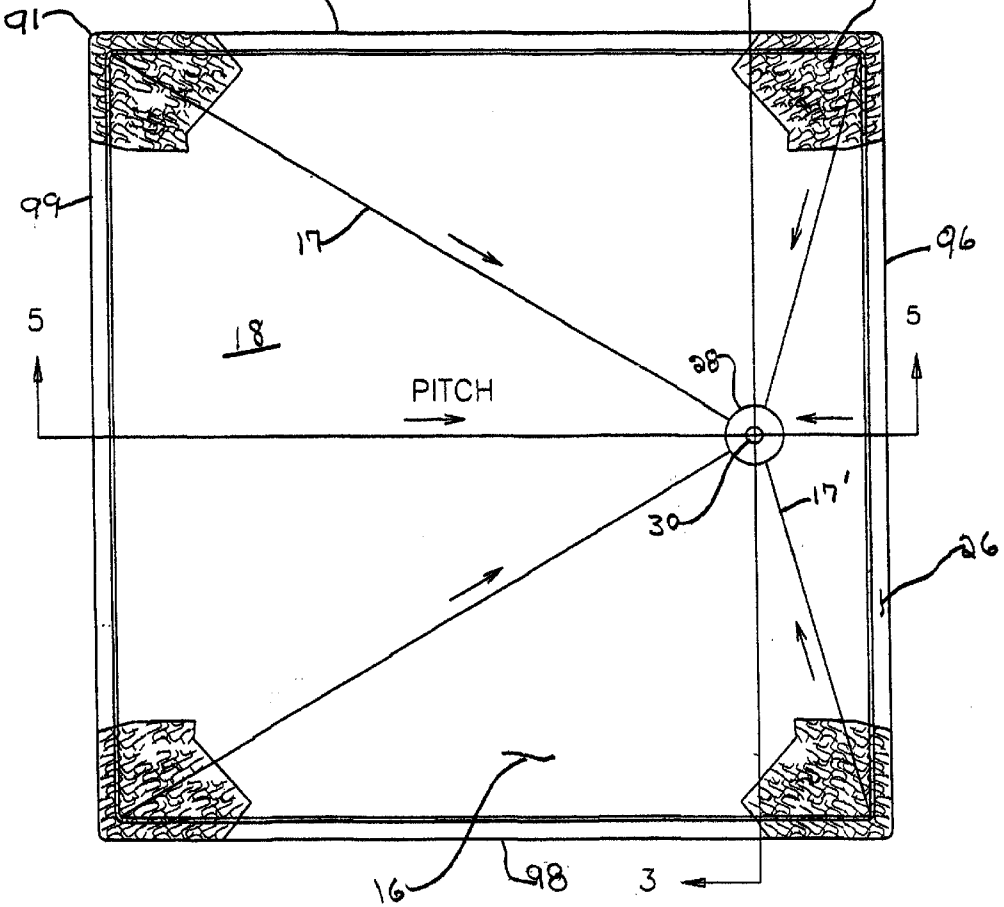
FIG. 2 shows top plan view.
Figure 5:
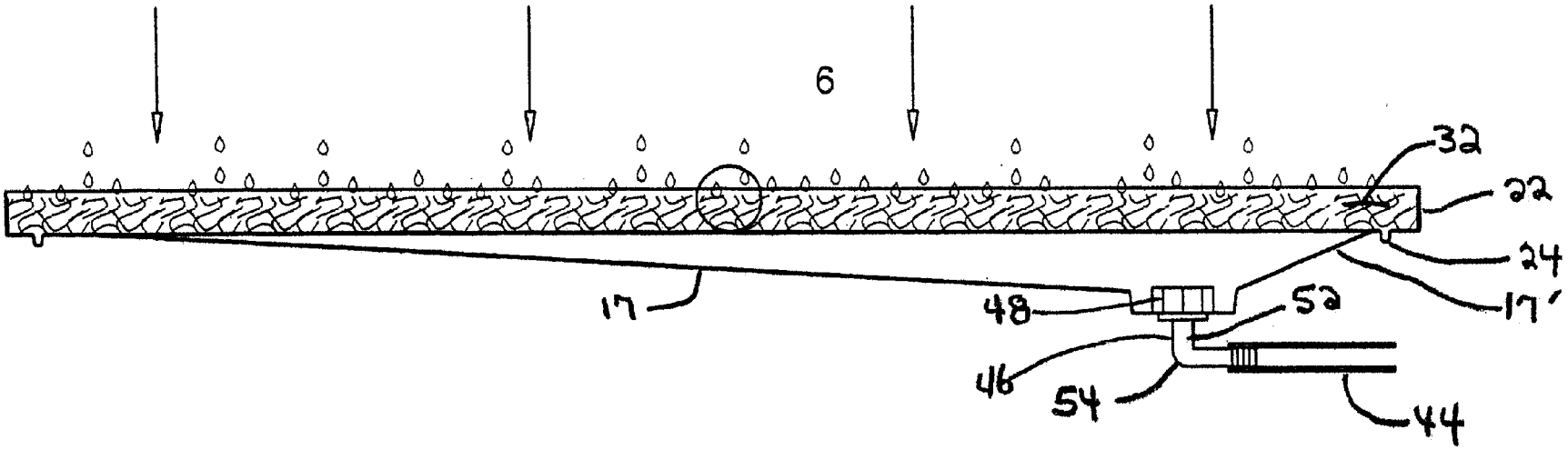
FIG. 5 is a sectional pictorial showing leak drops hitting mat fibers.
Figure 6:
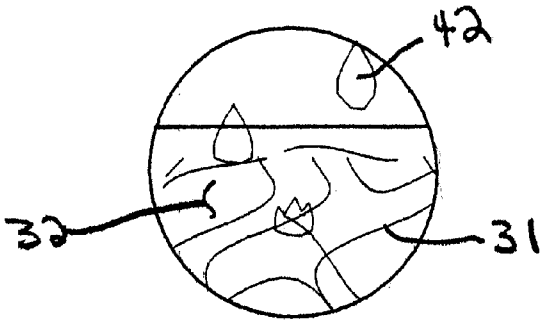
FIG. 6 is an enlarged view showing leak drops hitting mat fibers wherein the drops are broken to avoid splashing and impacting the panel.
Figure 7:
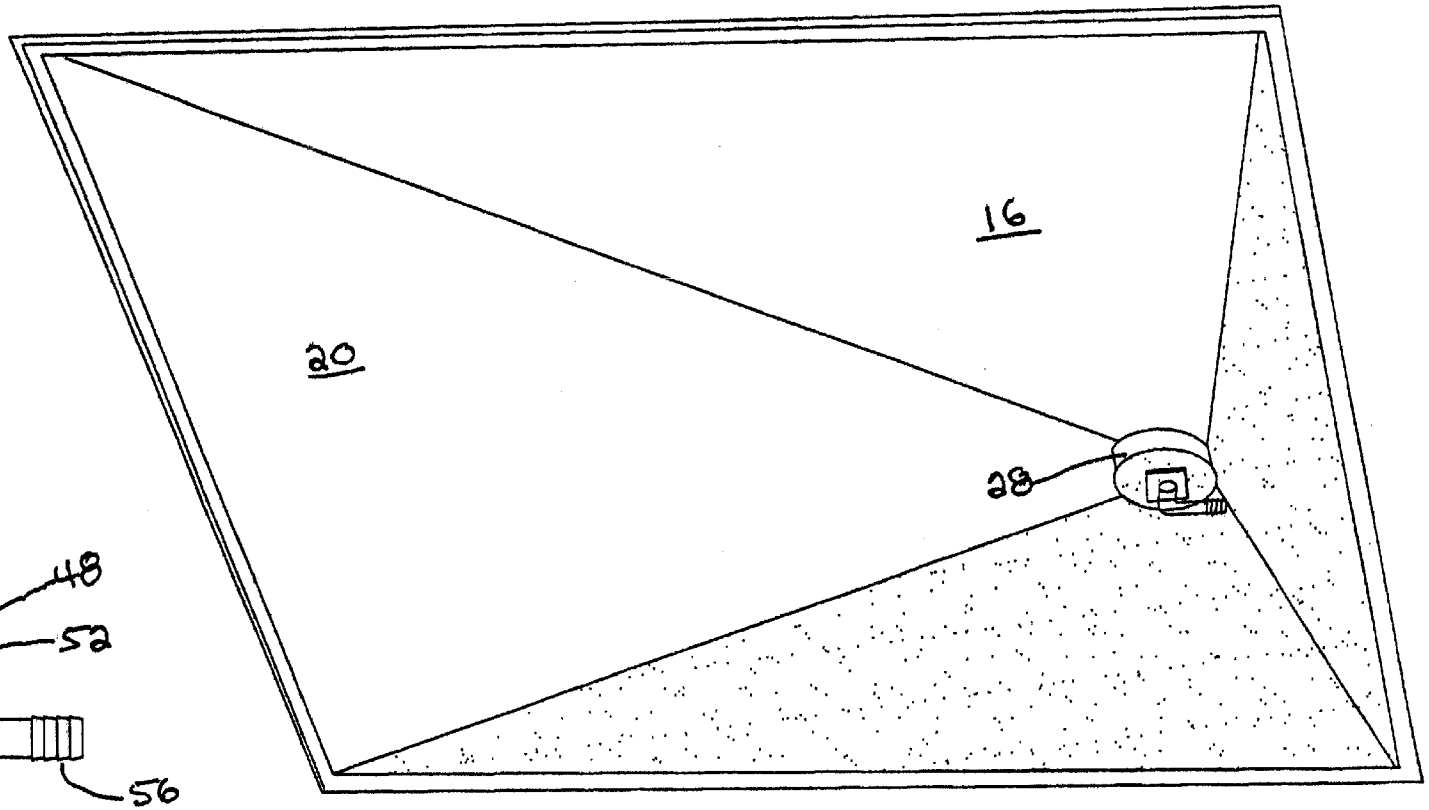
FIG. 7 is a pictorial of a panel.
Figure 8:
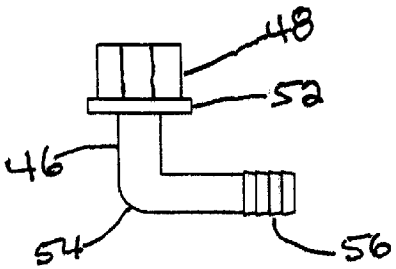
FIG. 8 shows detail of a drain connector.
Figure 9:
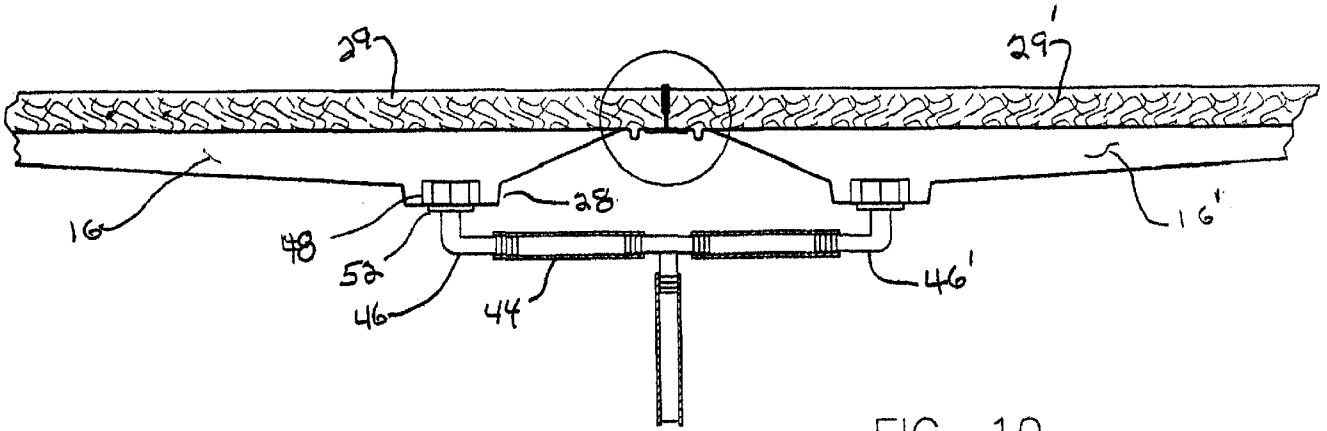
FIG. 9 indicates two panels connected for a larger area of protection.
Figure 10:
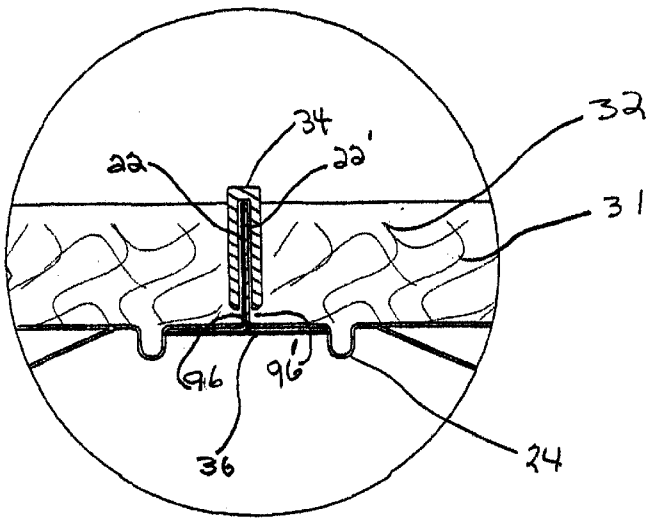
FIG. 10 is a sectional enlargement of the point of connection of two leak diverter panels.
Figure 11:
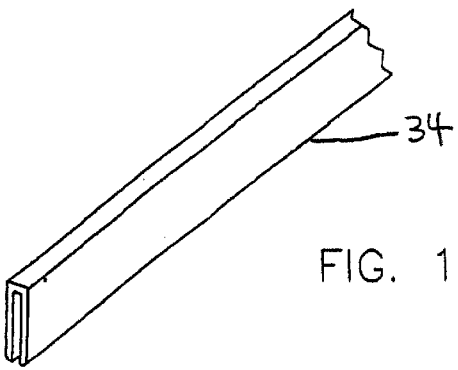
FIG. 11 is a pictorial of a fill width panel attachment clip used to join leak diverter panels.

In accordance with the invention, the panel 16 is a pan or tray like device shaped by heating and causing a sheet of firm but flexible plastic, preferably Acrylonitrile Butadiene Styrene or commonly called ABS, but not limited thereto, to conform to predetermined shape and size in a commercially available thermo-molding process called thermoforming. The aforementioned thermoforming process, for the instant design, causes the sheet to be permanently shaped in a custom made fixture with compound angle incline 17 which extends gradually downward from backside 99 at a corner 91 to a recessed drain mounting land 28 that is located close to an end 96 and central to left side 98 and right side 97. The thermoforming fixture is also designed to cause a flat ceiling grid support mounting pad 26 to be formed on a left side 98 to match and conform to the horizontal resting portion of acoustical ceiling mounting grid 38. The said fixture also causes like inclines and pads to be formed on the backside 99, right side 97 and the end 96 to match relatively located ceiling grids. The half inch flat ceiling grid support mounting pad 26 terminates in a perpendicular flange 22 on the outer edge forming an impervious tray like perimeter to increase the holding capacity of said leak diverter panel 16 to hold and store liquids when immediate disposal is not possible. A convex ridge 24 is formed along the inner edge of the flat ceiling grid support mounting pad 26 to add stability and to act as an aid in locating the leak diverter panel 16 properly in the ceiling mounting grid 38.

The preferred outside dimensions conform to a commercially available square, or rectangular tile 40 in a suspended grid ceiling 36 less minimal space to allow insertion and removal as a replacement for a tile. The perpendicular flange 22 is designed to synergistically conform to the design of ceiling mounting grid 38 that generally has an expanded area at the top of the vertical portion of said grid 38 to stabilize and increase the load-bearing capability of said grid 38. The perpendicular flange 22 enhances the Port-A-Tile leak diverter's utility by making it possible to join a leak diverter panel 16 with another leak diverter panel 16' during installation in a rectangular suspended grid ceiling 36 using a full length "U" channel mating clip 34 to join a perpendicular flange 22 of a first diverter panel 16 with a respective flange 22' of the other panel 16'. The said flange 22 also forms a perimeter to hold a plastic mesh splash mat 29 sized to fit within the perpendicular flange 22 in the leak diverter panel 16. In the preferred embodiment said mat 29 has an open non-woven plastic mesh 32 but may be other suitable non absorbent material that will break liquid droplets 42 on contact but is non absorbent so as to allow liquid to pass through after breaking surface tension and dispersing the drip on contact with the mat fiber 31. The recessed drain mounting land 28 has a circular portion removed to define an orifice 30 to allow attachment of a drain connector 46. The said connector 46 is attached at the time of operative installation. Droplets 42 collected by the panel 16 are channeled and diverted away for disposal or containment through a tubular drain line 44 that is functionally attached to said drain connector 46. The said drain connector 46 is inserted into the orifice 30 and secured to said drain mounting land 28 by tightening threaded nut 48 against an extrusion 52 capturing the land 28. The interiors of the connector 46 and the drain line 44 are hollow to allow liquid collected from said droplets 42 to flow by gravity. The drain connector 46 has a ninety-degree bend 54 such that in operative position a drain line 44 is essentially horizontal near the connector 46. The tubular drain line 44 is attached to a barbed male slip on adapter 56 which is part of the connector 46, and the collected droplets 42 can be diverted away for containment or disposal. An optional inline drain shut off valve (not shown) may be inserted into the tubular drain line 44 for use when immediate disposal of collected liquid droplets 42 is not possible or practical, causing the leak diverter panel 16 to temporarily contain rather than divert the accumulating liquid from the droplets 42.

The method for manufacturing the present invention utilizing the thermoforming process would include the steps of first obtaining and cutting to a convenient size a one sixteenth inch thick sheet of ABS. Then by making and using a thermoforming fixture and process with a specific shape and form cause said sheet to be stretched and molded to form a panel 16 by first creating a circular land 28, and then the stretching process continues to form a continuous and contiguous surface interior 18 with an incline 17 and incline 17' which extends toward and connects to a circumscribing ridge 24. Said ridge is formed adjacent to a circumscribing pad 26 in a parallel plane with the first said land 28. Outwardly circumscribing said pad 26 and perpendicular thereto is formed a flange 22 which extends away from the land 28. The flange 22 is the outermost useful part of the original sheet, and any excess material is cut away. The outside dimensions of the flange 22 are made to conform to commercially available ceiling tile 40 of the type used in common suspended ceilings. After the forming step and to complete the manufacture of a panel 16, an orifice 30 is cut into the land 28 adequate to receive a standard plumbing connector 46.

During the forming process, the face 20 of the panel 16 is exposed to atmospheric pressure while a vacuum is pulled against the interior 18 of the panel which is against said thermoforming fixture. It would be easily understood by anyone familiar with the art that the above steps create a vessel shaped to conform to a ceiling tile opening that could facilitate funneling of leak droplets toward a drain orifice.

A non-woven material in a sheet form approximately one-half inch thick is obtained and selected dense enough that any impinging water droplets 42 cannot pass directly through its thickness without hitting a fiber 31 and being arrested or broken thereby preventing splashing onto an adjacent ceiling tile 40', but in the opposite sense, light and open enough that moisture will not be absorbed and may evaporate if left adhering to a fiber 31. Said non-woven material is cut to form a mat 29 which is sized to the inside dimensions of the flange 22.

Continuing the process, when a ceiling leak is found and the owner wants a temporary means for diverting the leak droplets 42, a ceiling tile 40 is removed, a panel 16 is inserted into the space created by removing said tile 40, a connector 46 is connected and secured with a nut 48, and a tubular drain line 44 is functionally attached to the end adapter 56 of the connector 46 and which drain line 44 is plumbed to a location where the liquid will cause no harm.

In an alternate situation, a ceiling leak may drip randomly over an area larger than a single tile 40. To divert droplets 42 over a second tile 40', both tile 40 and tile 40' are removed and replaced by a panel 16 and a panel 16'. A mat 29 is placed into panel 16 to break the fall of droplets 42 and a mat 29' is placed into panel 16' similarly. If the replacement panels meet where there is no grid 38 a clip 34 is forced over two parallel, meeting flanges, a first flange 22 from the end 96 of the first panel 16 and a second flange 22' from the end 96' of second panel 16', and said clip 34 provides spring bracing pressure to hold the flanges together. Where the two panels meet at an edge supported by a grid 38, the clip 34 is forced over three flanges including a first flange 22 from a first panel 16, a second flange 22' from a second panel 16' and the third flange which is a standard reinforcement and part of the grid 38. Said clip 34 operates to hold together, by spring pressure, the two panels and the grid 38.

Figure 12:
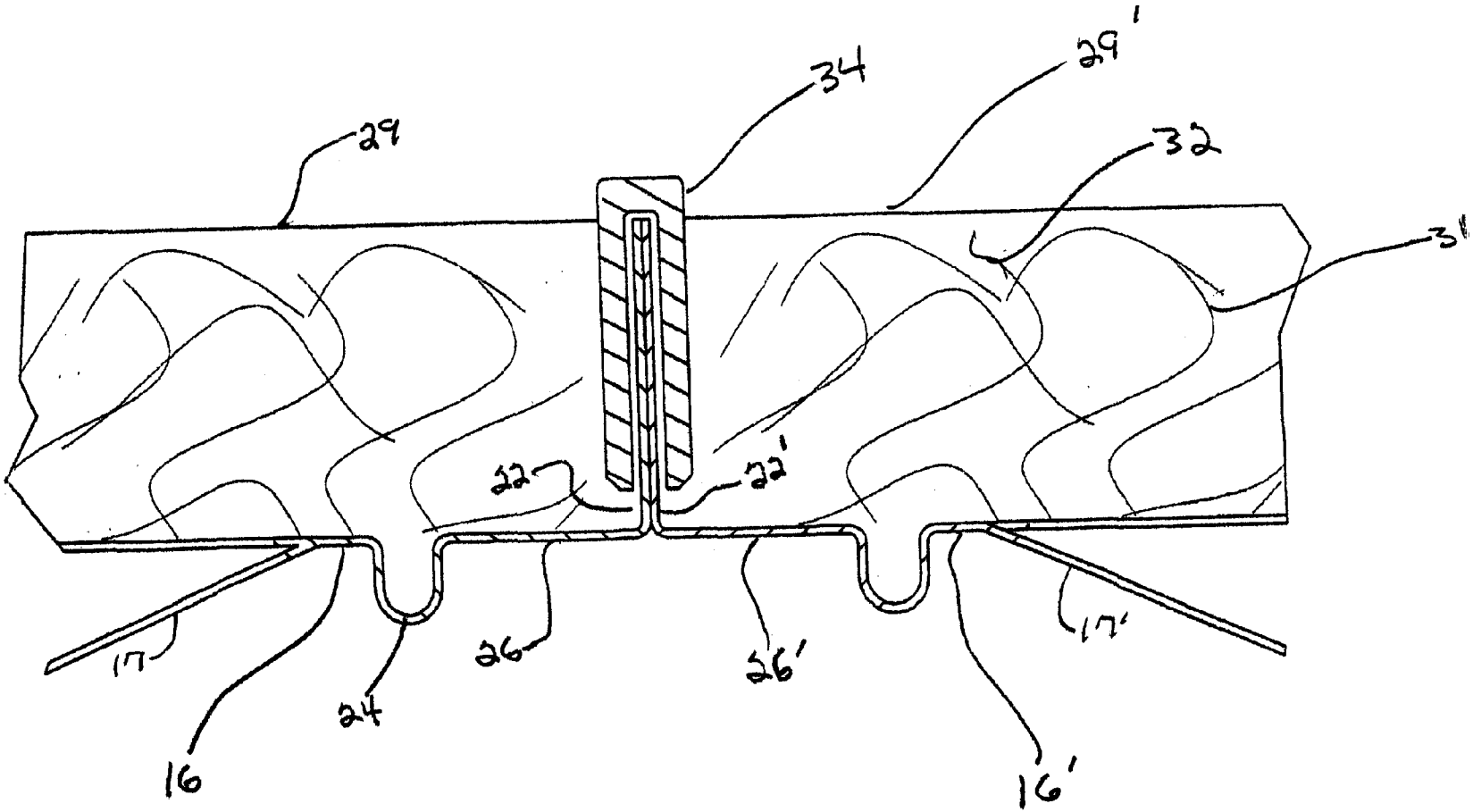
FIG. 12 is an alternate enlarged sectional view of connected panels for a larger ceiling tile.

As depicted in FIG. 12, and above described, said land 28 which is cut to define said orifice 30 is advantageously positioned relatively near the end 96 of the panel 16. Such positioning allows the drain connector 46 to be physically close to another connector 46' when two panels are used in combination. The connecting of drain line 44 to simultaneously serve both panels can then be easily accomplished.

What is claimed is:

1. A ceiling leak diverter system comprising:

a semi-rigid plastic ceiling panel having an interior with upward extending sides, said interior to include downward sloped surfaces that lead to a land with a portion shaped to define an orifice, said sides being contiguous and continuous defining a vessel that can retain liquids if said orifice is blocked, said sides including pads shaped and sized to match any existing commercial ceiling tiles and being designed to replace existing tiles in the event of a leak, said orifice being fitted to accept plumbing fixtures and tubing provides means for draining said container and diverting liquids to a harmless area, said sides are formed with upward extending flanges to increase the holding capacity of the panel and to strengthen the panel, said flanges retain a fiber mat that breaks the fall of droplets avoiding impacting noise and splashing, and said orifice is located relatively close to one of said sides in a manner that allows a drain line to run conveniently along and under the ceiling to interconnect a plurality of panels for a large leak area or multiple leak areas.

2. A method for protecting against damage from overhead leaks above a ceiling commonly known as a "hung ceiling" comprising the steps of:

providing at least one plastic vessel that has the size and shape of a ceiling tile and which includes upwardly extending sides and an interior that catch liquid droplets and channel them through an orifice located relatively close to one of said sides, replacing at least one existing ceiling tile of the hung ceiling when a leak occurs therein with said vessel, replacing multiple ceiling tiles by using multiple vessels interconnected at abutting extending sides to encompass larger leak areas, placing a fiber mat within said sides of each vessel to break the fall of droplets, and providing and interconnecting tubular means along and spaced below said hung ceiling for controlling the flow and channeling said liquid droplets from said at least one vessel to a convenient and harmless area.

3. The method for protecting against damage from overhead leaks of claim 2 wherein said fiber mat includes a nonwoven mat with fibers spaced close enough that a drop cannot pass straight through without being broken enough to eliminate splashing and to eliminate noise resulting from the droplet's impacting said bottom, and wherein said fibers are spaced widely enough that air passage can evaporate wetness.

4. The method for protecting against damage from overhead leaks of claim 2 wherein the step of using multiple vessels to encompass larger leak areas includes the steps of:

placing vessels juxtaposed and clipped together with outlet orifices in close arrangement, and connecting both orifices to a single tubular drain means.

* * * * *